US011053748B2

(12) United States Patent
Boddeda

(10) Patent No.: US 11,053,748 B2
(45) Date of Patent: Jul. 6, 2021

(54) EXPANDABLE CONNECTION WITH METAL-TO-METAL SEAL

(71) Applicant: Enventure Global Technology, Inc., Houston, TX (US)

(72) Inventor: Nanda Kishore Boddeda, Houston, TX (US)

(73) Assignee: ENVENTURE GLOBAL TECHNOLOGY, INC., Houston, TX (US)

( * ) Notice: Subject to any disclaimer, the term of this patent is extended or adjusted under 35 U.S.C. 154(b) by 0 days.

(21) Appl. No.: 16/634,560

(22) PCT Filed: Jul. 27, 2018

(86) PCT No.: PCT/US2018/044022

§ 371 (c)(1),
(2) Date: Jan. 27, 2020

(87) PCT Pub. No.: WO2019/023535

PCT Pub. Date: Jan. 31, 2019

(65) Prior Publication Data

US 2020/0232287 A1 Jul. 23, 2020

Related U.S. Application Data

(60) Provisional application No. 62/537,644, filed on Jul. 27, 2017.

(51) Int. Cl.

| | |
|---|---|
| ***E21B 17/042*** | (2006.01) |
| ***B21D 39/04*** | (2006.01) |
| ***E21B 19/16*** | (2006.01) |

(52) U.S. Cl.
CPC ..... *E21B 17/042* (2013.01); *B21D 39/04* (2013.01); *E21B 19/16* (2013.01)

(58) Field of Classification Search
CPC ..... E21B 17/042; E21B 43/106; E21B 43/103
See application file for complete search history.

(56) References Cited

U.S. PATENT DOCUMENTS

| | | | |
|---|---|---|---|
| 6,409,175 | B1 | 6/2002 | Evans et al. |
| 2002/0163192 | A1 | 11/2002 | Coulon et al. |
| 2004/0231839 | A1 | 11/2004 | Ellington et al. |
| 2005/0236834 | A1 | 10/2005 | Curley et al. |
| 2006/0061099 | A1 | 3/2006 | Evans et al. |
| 2007/0272419 | A1 | 11/2007 | Costa et al. |
| 2010/0052319 | A1 | 3/2010 | Benzie et al. |
| 2010/0132956 | A1 | 6/2010 | LeBedz et al. |
| 2010/0230958 | A1 | 9/2010 | Holland |

(Continued)

OTHER PUBLICATIONS

International Search Report and Written Opinion of application PCT/US18/44022 dated Oct. 12, 2018, 11 pages.

*Primary Examiner* — Kristyn A Hall
(74) *Attorney, Agent, or Firm* — Jonathan Pierce; Pierre Campanac; Porter Hedges LLP

(57) ABSTRACT

An expandable connection is configured such that a metal-to-metal seal is created upon expansion, even under different expansion ratios. The creation of the metal-to-metal seal can rely on a spring-back effect after expansion. A high pressure rating of the metal-to-metal seal that is created can be achieved with an oversized box face thickness. The expandable connection can also be configured to achieve a high tensile efficiency.

13 Claims, 1 Drawing Sheet

(56) References Cited

U.S. PATENT DOCUMENTS

| | | | | |
|---|---|---|---|---|
| 2011/0094753 | A1 | 4/2011 | Whiddon | |
| 2012/0152565 | A1 | 6/2012 | Bennett et al. | |
| 2012/0152567 | A1 | 6/2012 | Whiddon et al. | |
| 2012/0325361 | A1 | 12/2012 | Durivault et al. | |
| 2015/0285009 | A1* | 10/2015 | Bennett | E21B 17/042 285/333 |

* cited by examiner

EXPANDABLE CONNECTION WITH METAL-TO-METAL SEAL

BACKGROUND

This disclosure relates generally to methods and apparatus for radially expanding connected tubular members in a wellbore. In particular, this disclosure relates to the radial expansion of tubular members that are connected via a threaded connection offering improved efficiency as compared to conventional expandable threaded connections.

During hydrocarbon exploration, a wellbore typically traverses a number of zones within a subterranean formation. Wellbore casings are then formed in the wellbore by radially expanding and plastically deforming tubular members that are coupled to one another by threaded connections. In certain wellbore environments, existing apparatus and methods for coupling together and radially expanding tubular members may not be suitable.

For example, a series of expanded tubular members can be subjected to elevated axial loads during installation, under pressure loading, or when subjected to significant temperature differentials during certain wellbore operations. The maximum axial load that can be applied to a series of expanded tubular members is, in most instances, limited by the threaded connections between adjacent tubular members. To quantify the performance of an expandable threaded connection, connections are often referred to as having an efficiency, which is defined as the tensile rating of the connection divided by the tensile rating of the base tubular.

Many expandable threaded connections rely on elastomeric materials to provide a seal. Elastomeric seals may not be suitable for certain high-temperature environments on when exposed to certain wellbore fluids. In conditions where elastomeric seals may not be desirable, it may be preferable to have a threaded connection that utilizes a metal-to-metal seal. A connection that utilizes a metal-to-metal seal forms a seal between two abutting surfaces of the threaded connections that contact with sufficient compressive force to form a seal between the surfaces. An example of a known connection that utilizes a metal-to-metal seal is described in U.S. Application Pub. No. 2015/0285009.

Although there are many available examples of threaded connections that utilize metal-to-metal seals, those threaded connections that are also rated for radial expansion have not proven suitable for all applications. Thus, there is a continuing need in the art for methods and apparatus for providing an expandable threaded connection with a metal-to-metal seal that also provides increased efficiency and ability to handle increased tensile loads.

SUMMARY

The disclosure describes a method of expanding tubular members.

The method may comprise forming a threaded pin end on a first expandable tubular member. The pin end may have a first inner diameter that is less than a second inner diameter of the first expandable tubular member. An inner diameter of the pin end may increase on both sides of the first inner diameter. The first inner diameter may be located at a base of threads.

The method may comprise forming a threaded box end on a second expandable tubular member. A wall thickness of the box end may vary from being thinner near an extremity of the threads, and may increase toward a face of the box end.

The wall thickness of the box end may also increase toward a body of the second expandable tubular member.

The method may comprise engaging the box end and the pin end to form an expandable assembly having an expandable threaded connection with one or two metal-to-metal seals. A thickness of the expandable threaded connection that is a sum of a thickness of the box end and a thickness of the pin end, may be maximum at the face of the box end.

The method may comprise disposing the expandable assembly in a wellbore, and moving an expansion cone longitudinally through the first expandable tubular member, the expandable threaded connection, and the second expandable tubular member so as to radially expand the first inner diameter and the second inner diameter to an expanded inner diameter.

The method may further comprise creating a metal-to-metal seal from a spring-back effect after moving the expansion cone.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
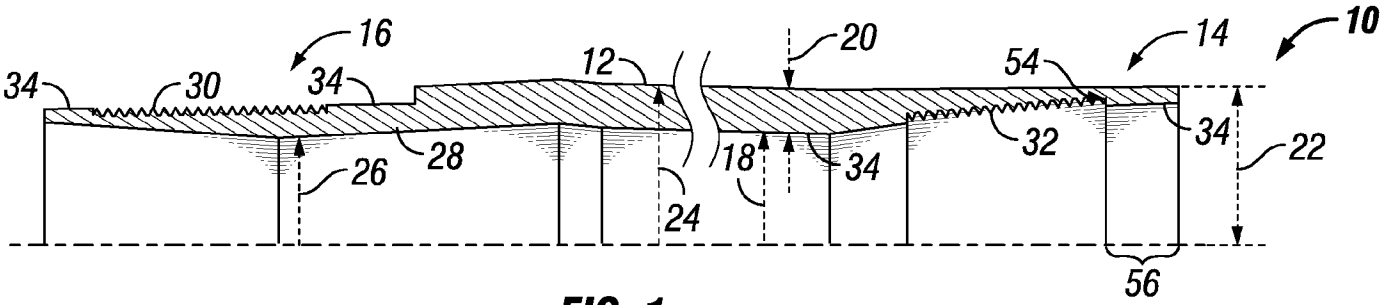
FIG. 1 is a partial cross-sectional view of an expandable tubular member.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, an expandable tubular 10 comprises a main body 12 having a threaded box end 14 and a threaded pin end 16. The main body 12 has an unexpanded inner diameter 18 and a wall thickness 20. The box end 14 includes threads 32 formed on its inner surface that are configured to engage with threads 30 formed on the outer surface of the pin end 16. The threads 30, 32 may be any threads suitable for use with expandable tubulars.

Pin end 16 has a minimum inner diameter 26 that is smaller than the inner diameter 18. The inner diameter along the pin end 16 varies from being smaller near the base 28 of the thread and then increases on both sides of the minimum inner diameter 26, that is, on the side toward the pin end 16 as well as on the side toward the main body 12. As such, the inner profile of the pin end 16 forms a "V" shape having a cusp near the base 28 of threads 30. The wall thickness of the pin end 16 varies from being thicker near the main body 12 and then tapering toward the end of the pin end 16.

The box end 14 has an outer diameter 22 that is substantially the same as an outer diameter 24 of the main body 12. The box end 14 extends beyond the extremity 54 of the threads 32 over an unthreaded length 56, which may be approximately 3 times longer than the wall thickness at the face 42 of the box end 14. The wall thickness of the box end 14 varies from being thinner near the extremity 54 of the threads 32, then increases toward the face 42 of the box end 14. Accordingly, the face 42 of the box end 14 is thicker (as compared to conventional flush-joint connections). The wall thickness of the box end 14 also increases from the extremity 54 of the threads 32 toward the main body 12.

In certain embodiments, the box end 14 and/or pin end 16 may include sealing surfaces 34 that are configured to facilitate metal-to-metal sealing engagement of the threads prior to expansion.

Figure 2:
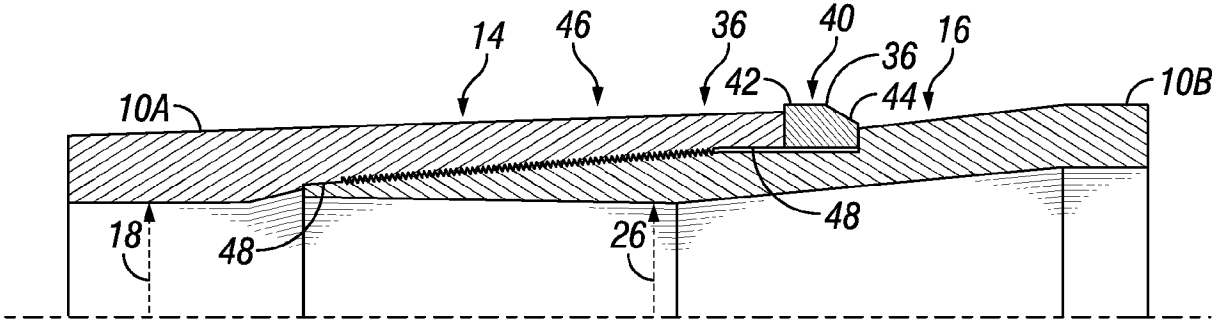
FIG. 2 is a partial cross-sectional view of an expandable threaded connection in an unexpanded condition.

FIG. 2 shows the box end 14 of one expandable tubular 10A engaged with the pin end 16 of another expandable tubular 10B to form an expandable tubular assembly 36. A spacer ring 38 is disposed about the pin end 16 in a groove 40 formed between the face 42 of the box end 14 and a shoulder 44 on the pin end 16. The coupled box end 14 and pin end 16 form a threaded connection 46 that has a minimum inner diameter 26 that is smaller than the inner diameter 18 of the main bodies 12. The threaded connection 46 includes metal-to-metal seals 48 at either end of the engagement of box end 14 and pin end 16.

The thickness of the threaded connection 46, which is the sum of the thickness of the box end 14, and the thickness of the pin end 16 is preferably maximum at the face 42 of the box end 14.

Figure 3:
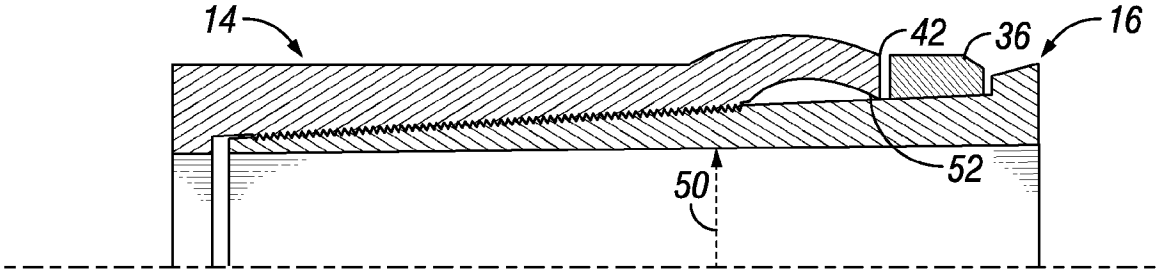
FIG. 3 is a partial cross-sectional view of an expandable threaded connection in an expanded condition.

In operation, an expansion cone (not shown) having an expansion diameter that is greater than both inner diameter 18 and minimum inner diameter 26 is moved axially through the tubular assembly 36 so as to radially expand the expandable tubular 10B, the threaded connection 46, and then the expandable tubular 10A. As shown in FIG. 3, once the expansion is complete, the now expanded tubular assembly 36 has a substantially uniform inner diameter 50. After the tubular assembly 36 is expanded, the box end 14 and the pin end 16 are deformed, and the metal-to-metal seals 48 at either end of the engagement of box end 14 and pin end 16 may open. However, the face 42 of the box end 14 springs back and the inner surface of box end 14 is compressed against the outer surface of the pin end 16. This compression forms a metal-to-metal seal 52. The location where the metal-to-metal seal 52 is formed may be different from the initial location of the metal-to-metal seals 48.

Forming the pin end threaded connection on a portion of the tubular with an inner diameter less than the main body inner diameter allows the thread to be formed closer to the center of the tubular and on a thicker portion of the tubular as compared to conventional flush-joint threaded connections. This also allows the box end threaded connection to be formed closer to the center of the tubular (as compared to conventional flush-joint connections), which provides thicker material at the end of the tubular that can be utilized to create the metal-to-metal seal described herein. Thus, the disclosed embodiment that provides a threaded connection that has a thicker wall section as compared to conventional expandable flush-joint connections without an unacceptable increase in the expansion forces needed to expand the threaded connection. Therefore, the disclosed embodiments provide greater resistance to tensile loads, and therefore a greater efficiency, as compared to conventional expandable threaded connections.

In addition, because of the inner diameter variations along the pin end, the plastic deformation of the threaded connection that occurs during expansion may be larger near the minimum inner diameter. Further, because of the thickness variation along the box end, the amount of spring-back that occurs after expansion at the extremity of the threads of the box end may be less than the amount of spring-back that occurs at the face of the box end. As such, the unthreaded length of the box end may rotate and form a new metal-to-metal seal after expansion. In some embodiments, the pressure contact at the new metal-to-metal seal may be sufficient to prevent the seal from opening under a differential pressure of 10,000 psi or less between inside and outside the expanded tubulars.

In contrast with other known expandable connections having a metal-to-metal seal, the expandable connection described herein may be expanded at different expansion ratio, (i.e., using any of several expansions cones having different expansion diameters) while still providing a metal-to-metal seal after expansion of the threaded connection.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A method comprising:

forming a threaded pin end on a first expandable tubular member, wherein the threaded pin end has a first inner diameter that is less than a second inner diameter of the first expandable tubular member, wherein an inner diameter of the threaded pin end increases on both sides of the first inner diameter;

forming a threaded box end on a second expandable tubular member;

engaging the threaded box end and the threaded pin end to form an expandable assembly having an expandable threaded connection with a first metal-to-metal seal;

disposing the expandable assembly in a wellbore; and moving an expansion cone longitudinally through the first expandable tubular member, the expandable threaded connection, and the second expandable tubular member so as to radially expand the first inner diameter and the second inner diameter to an expanded inner diameter.

2. The method of claim 1, further comprising creating a second metal-to-metal seal from a spring-back effect after moving the expansion cone.

3. The method of claim 1, wherein a wall thickness of the threaded box end varies from being thinner near an extremity of threads, and increases toward a face of the threaded box end.

4. The method of claim 3, wherein the wall thickness of the threaded box end increases toward a body of the second expandable tubular member.

5. The method of claim 1, wherein a thickness of the expandable threaded connection, which is a sum of a thickness of the threaded box end and a thickness of the threaded pin end, varies and is maximum at a face of the threaded box end.

6. The method of claim 1, wherein the first inner diameter is located at a base of threads.

7. A method comprising:

forming a threaded pin end on a first expandable tubular member, wherein the threaded pin end has a first inner diameter;

forming a threaded box end on a second expandable tubular member, wherein a wall thickness of the threaded box end varies from being thinner near an extremity of threads, increases toward a face of the threaded box end, and increases toward a body of the threaded box end;

engaging the threaded box end and the threaded pin end to form an expandable assembly having an expandable threaded connection with a first metal-to-metal seal, wherein a thickness of the expandable threaded connection, which is a sum of a thickness of the threaded box end and a thickness of the threaded pin end, varies and is maximum at a face of the threaded box end;

disposing the expandable assembly in a wellbore; and moving an expansion cone longitudinally through the first expandable tubular member, the expandable threaded connection, and the second expandable tubular member so as to radially expand the first inner diameter to an expanded inner diameter.

8. The method of claim 7, further comprising creating a second metal-to-metal seal from a spring-back effect after moving the expansion cone.

9. The method of claim 7, wherein the first inner diameter is less than a second inner diameter of the first expandable tubular member.

10. The method of claim 9, wherein an inner diameter of the threaded pin end increases on both sides of the first inner diameter.

11. The method of claim 10, wherein the first inner diameter is located at a base of threads.

12. A method comprising:

forming a threaded pin end on a first expandable tubular member, wherein the threaded pin end has a first inner diameter that is less than a second inner diameter of the first expandable tubular member, wherein an inner diameter of the threaded pin end increases on both sides of the first inner diameter, and wherein the first inner diameter is located at a base of threads;

forming a threaded box end on a second expandable tubular member, wherein a wall thickness of the threaded box end varies from being thinner near an extremity of threads, increases toward a face of the threaded box end, and increases toward a body of the threaded box end;

engaging the threaded box end and the threaded pin end to form an expandable assembly having an expandable threaded connection with a first metal-to-metal seal;

disposing the expandable assembly in a wellbore;

moving an expansion cone longitudinally through the first expandable tubular member, the expandable threaded connection, and the second expandable tubular member so as to radially expand the first inner diameter and the second inner diameter to an expanded inner diameter; and creating a second metal-to-metal seal from a spring-back effect after moving the expansion cone.

13. The method of claim 12, wherein a thickness of the expandable threaded connection, which is a sum of a thickness of the threaded box end and a thickness of the threaded pin end, varies and is maximum at a face of the threaded box end.

* * * * *